US006227824B1

(12) United States Patent
Stehr

(10) Patent No.: US 6,227,824 B1
(45) Date of Patent: May 8, 2001

(54) FLUID PUMP WITHOUT NON-RETURN VALVES

(75) Inventor: Manfred Stehr, Villingen-Schwenningen (DE)

(73) Assignee: Han-Schickard-Gesellschaft für angewandte Forschung e.V. (DE)

( * ) Notice: Subject to any disclaimer, the term of this patent is extended or adjusted under 35 U.S.C. 154(b) by 0 days.

(21) Appl. No.: 09/043,236

(22) PCT Filed: Sep. 3, 1996

(86) PCT No.: PCT/EP96/03863

§ 371 Date: Mar. 13, 1998

§ 102(e) Date: Mar. 13, 1998

(87) PCT Pub. No.: WO97/10435

PCT Pub. Date: Mar. 20, 1997

(30) Foreign Application Priority Data

Sep. 15, 1995 (DE) ..... 195 34 378
Jun. 18, 1996 (DE) ..... 196 24 271

(51) Int. Cl.[7] ..... F04B 11/00
(52) U.S. Cl. ..... 417/540; 417/557
(58) Field of Search ..... 417/540, 479, 417/557, 413.1, 413.3

(56) References Cited

U.S. PATENT DOCUMENTS 3,661,060 * 5/1972 Bowen ..... 92/102
4,915,017 * 4/1990 Perlov ..... 95/5 R
5,611,676 * 3/1997 Ooumi et al. ..... 417/322
5,718,567 * 2/1998 Rapp et al. ..... 417/395

FOREIGN PATENT DOCUMENTS 02149778 6/1990 (JP) .
02283877 11/1990 (JP) .
2-308988 12/1990 (JP) .
04086388 3/1992 (JP) .
5-502083 4/1993 (JP) .
6-47675 6/1994 (JP) .
WO 92/01160 1/1992 (WO) .

* cited by examiner

*Primary Examiner*—Henry C. Yuen
*Assistant Examiner*—Mahmoud M Gimie
(74) *Attorney, Agent, or Firm*—Duft, Graziano & Forest, P.C.

(57) ABSTRACT

A fluid pump has a pump body and a displacer which is adapted to be positioned at a first and at a second end position by means of a drive, the displacer and the pump body being implemented such that a pump chamber is defined therebetween, and the pump chamber being adapted to be fluid-connected to an inlet and to an outlet via a first opening and a second opening which are not provided with check valves. An elastic buffer bordering on the pump chamber is provided. The displacer is implemented in the form of a plate which is secured to the pump body, and the pump body is provided with a recess defining the pump chamber. The drive acts on the displacer substantially in the area of the first opening. The displacer closes the first opening when it occupies its first end position and leaves the first opening free when it occupies its second end position. The drive means moves the displacer so abruptly from the second to the first end position that a deformation of the buffer means is caused by the movement of the displacer.

30 Claims, 8 Drawing Sheets

FLUID PUMP WITHOUT NON-RETURN VALVES

BACKGROUND OF THE INVENTION

1. Field of the Invention

The present invention refers to fluid pumps.

2. Description of Prior Art

It is known to use positive-displacement pumps for transporting liquids and gases, said positive-displacement pumps consisting of a periodic displacer, a piston or a diaphragm, and two passive check valves. Due to the periodic movement of the piston or of the diaphragm, liquid is drawn into a pump chamber through the inlet valve and displaced from said pump chamber through the outlet valve. The direction of transport is predetermined by the arrangement of the valves. When the pumping direction of such an arrangement is to be reversed, such known pumps require a change of the operating direction of the valves from outside which entails a high expenditure. Such pumps are shown e.g. in Jarolav and Monika Ivantysyn; "Hydrostatische Pumpen and Motoren"; Vogel Buchverlag, Würzburg, 1993.

Pumps of this type having a small constructional size and delivering small pumped streams are referred to as micropumps. The displacers of such pumps are typically implemented as a diaphragm, cf. P. Gravesen, J. Branebjerg, O. S. Jensen; Microfluids—A review; Micro Mechanics Europe Neuchatel, 1993, pages 143–164. The displacers can be driven by different mechanisms. Piezoelectric drive mechanisms are shown in H. T. G. Van Lintel, F. C. M. Van de Pol. S. Bouwstra, A Piezoelectric Micropump Based on Micromachining of Silicon, Sensors & Actuators, 15, pages 153–167, 1988, S. Shoji, S. Nakagawa and M. Esashi, Micropump and sample injector for integrated chemical analyzing systems; Sensors and Actuators, A21–A23 (1990), pages 189–192, E. Stemme, G. Stemme; A valveless diffuser/nozzle based fluid pump; Sensors & Actuators A, 39 (1993) 159–167, and T. Gerlach, H. Wurmus; Working principle and performance of the dynamic micropump; Proc. MEMS'95; (1995), pages 221–226; Amsterdam, The Netherlands. Thermopneumatic mechanisms for driving the displacers are shown in F. C. M. Van de Pol, H. T. G. Van Lintel, M. Elwenspoek and J. H. J. Fluitman, A Termo-pneumatic Micropump Based on Micro-engineering Techniques, Sensors & Actuators, A21–A23, pages 198–202, 1990, B. B üstgens, W. Bacher, W. Menz, W. K. Schomburg; Micropump manufactured by thermoplastic molding; Proc. MEMS'94; (1994), pages 18–21. An electrostatic mechanism is shown in R. Zengerle, W. Geiger, M. Richter, J. Ulrich, S. Kluge, A. Richter; Application of Micro Diaphragm Pumps in Microfluid Systems; Proc. Actuator '94; 15.–17.6.1994; Bremen, Germany; pages 25–29. Furthermore, the displacers can be driven thermomechanically or magnetically.

As is also shown in the above-mentioned publications, either passive check valves or special flow nozzles can be used as valves. The direction of transport of micropumps can be reversed without forcibly controlling the valves, simply by effecting control at a frequency above the resonant frequency of said valves. In this context R. Zengerle, S. Kluge, M. Richter, A. Richter; A Bidirectional Silicon Micropump; Proc. MEMS '95; Amsterdam, Netherlands; pages 19–24, J. Ulrich, H. Füller, R. Zengerle; Static and dynamic flow simulation through a KOH-etched micro valve; Proc. TRANSDUCERS '95, Stockholm, Sweden, (1995), pages 17–20, should be taken into account. The cause of this effect is a phase displacement between the movement of the displacer and the opening state of the valves. If the phase difference exceeds 90°, the opening state of the valves is anticyclic to their state in the normal forward mode and the pumping direction is reversed. A change of the operating direction of the valves from outside of the type required when macroscopic pumps are used can be dispensed with. The decisive phase difference between the displacer and the valves depends on the drive frequency of the pump on the one hand and on the resonant frequency of the movable valve member in the liquid surroundings on the other.

One disadvantage of this embodiment is to be seen in the fact that, upon constructing the valves, a compromise has to be found between the mechanical resonance in the liquid surroundings, the flow resistance, the fluidic capacity, i.e. the elastic volume deformation, the constructional size and the mechanical stability of these valves. It follows that these parameters, each of which may influence the pumping dynamics, cannot be ajusted to an optimum value independently of one another and part of them is opposed to a desired further miniaturization of the pump dimensions.

A general disadvantage entailed by the use of pumps with passive check valves is also the fact that, when switched off, the pumps do not block the medium to be transported. If the input pressure exceeds the output pressure by the pretension of the valves, the medium to be pumped will flow through the pump.

Micropumps using special flow nozzles have the disadvantage that they have a very low maximum pumping efficiency in the range of 10 to 20%.

A micropump of the type discussed, which is provided with check valves, is disclosed e.g. in EP 0 568 902 A2. This micropump is driven by means of the reciprocal movement of a diaphragm. The movement of the diaphragm causes a change in the volume of a pump chamber defined by the diaphragm and a carrier component. The outlet and the inlet of the micropump are provided with an outlet valve and an inlet valve, respectively.

WO-A-87/07218 discloses a piezoelectrically driven pressure-generating means comprising an electrically controllable diaphragm consisting of a first piezoelectrically excitable layer and a support layer which is fixedly connected to said excitable layer. The diaphram has a piezoelectrically excitable peripheral area and a piezoelectrically excitable central area, said areas being controlled in such a way that, for causing diaphram deflection, the diaphragm is reduced in length in its peripheral deflection, the diamphragm is reduced in length in its peripheral area by transverse contraction and increased in length in its central area. WO-A-87/07218 additionally discloses a fluid pump which makes use of three interconnected diaphragms of the type described hereinbefore, a first diaphragm serving as an inlet valve, a second diaphragm delimiting a variable hollow space and a third diaphragm serving as an outlet valve.

FR-A-2478220 discloses a pump in the case of which two drive means are provided for moving a flexible diaphragm, which is provided with a movable plate, into different end positions. The diaphragm is attached to a carrier plate having a central inlet opening. The diaphragm is provided with outlet openings. A pumping effect from the inlet opening to the outlet openings can be produced by controlling the diaphragm in a suitable manner.

SUMMARY OF THE INVENTION

It is the object of the present invention to provide efficient fluid pumps which have a simple structural design and which do not include any check valves.

In accordance with a first aspect of the invention this object is achieved by a fluid pump comprising:

a pump body;

a displacer which is adapted to be positioned at a first and at a second end position by means of a drive, the displacer and the pump body being implemented such that a pump chamber is defined therebetween, and said pump chamber being adapted to be fluid-connected to an inlet and to an outlet via a first opening and a second opening which are not provided with check valves; and an elastic buffer bordering on said pump chamber;

said displacer being implemented in the form of a plate which is secured to the pump body, and said pump body being provided with a recess defining the pump chamber;

said drive acting on the displacer substantially in the area of the first opening;

said displacer closing said first opening when it occupies its first end position and leaving said first opening free when it occupies its second end position; and said drive means moving the displacer so abruptly from the second to the first end position that a deformation of the buffer means is caused by the movement of said displacer.

A fluid pump according to the present invention does not require any check valves, neither passive nor active ones. In addition, the fluid pump according to the present invention can be used for actively blocking the fluid in both directions. In the case of the pump according to the present invention a reversal of the direction of transport can be achieved without forcibly controlling valves from outside and without making use of a resonance of passive check valves. The pumping efficiency which can be achieved by the pump according to the present invention can be optimized by controlling the time sequence of driving the displacer into the first and into the second end position, i.e. by controlling the clock ratio. The achievable pumping efficiency can also be optimized by adapting the cross-sections of the first and second openings.

In addition, the present invention is based on the finding that it is possible to provide a self-priming fluid pump, e.g. a self-priming micropump, by drastically reducing the dead volume developing in the micropump, i.e. the volume which is only moved to and from without contributing to the pumping process. Autofilling in combination with a simple control of the pump drive means becomes reproducible in this way.

In accordance with a second aspect of the present invention this object is achieved by a check valve-free fluid pump comprising:

a pump body;

a flexible displacer which is attached to the pump body in a fluid-tight manner along its circumference and which is movable with the aid of a drive means to a first and a second end position;

the pump body and the flexible displacer defining a pumping space which is adapted to be fluid-connected to an inlet and to an outlet via a first opening and a second opening arranged in spaced relationship with said first opening;

said displacer closing the first and the second opening when it occupies the first end position;

said drive means acting on said flexible displacer essentially in the area of said first opening in such a way that said displacer opens said first opening, while the second opening is substantially closed, when said displacer is moved by said drive means from the first end position to the second end position; and said drive means moving the displacer so abruptly from the second end position to the first end position that a buffer volume is formed between the displacer and the pump body by an elastic deformation of the displacer.

In accordance with a third aspect of the present invention this object is achieved by a check valve-free fluid pump having the following features:

a pump body;

a flexible displacer which is attached to the pump body in a fluid-tight manner along its circumference and which is movable with the aid of a drive means to a first and a second end position;

the pump body and the flexible displacer defining a pumping space which is adapted to be fluid-connected to an inlet and to an outlet via a first opening and a second opening;

said first and second openings being arranged in spaced relationship with one another on different sides of a central axis of the displacer;

said drive means acting on the flexible displacer substantially in the area of the first opening so as to move said displacer to the first and to the second end position;

said displacer closing the first opening when it occupies its first end position and leaving said first opening free when it occupies its second end position; and said drive means moving the displacer so abruptly from the second end position to the first end position that a buffer volume is formed between said displacer and said pump body by an elastic deformation of the displacer.

The fluid pump according to the second and third aspects of the present invention consists preferably of a pump body in the form of a plate and of a displacer in the form of a diaphragm. The plate has preferably formed therein the inlet opening and the outlet opening. The displacer in the form of the diaphragm can directly rest on a main surface of the plate when it occupies its position of rest. Furthermore, a capillary gap can be formed between the displacer in the form of the diaphragm and a main surface of the plate.

Further developments of the present invention are disclosed in the dependent claims.

BRIEF DESCRIPTION OF THE DRAWINGS

Making reference to the drawings enclosed, preferred embodiments of the present invention will be explained in detail hereinbelow, identical elements in different drawings being designated by identical reference numerals.

DESCRIPTION OF PREFERRED EMBODIMENTS OF THE INVENTION

Figure 1:
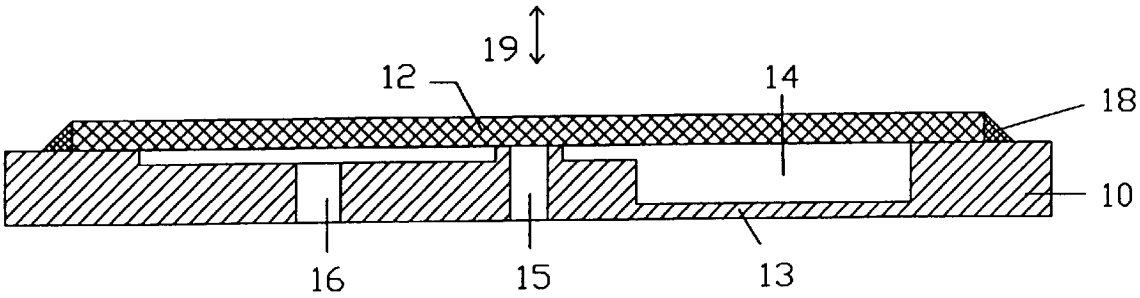
FIG. 1 shows a schematic cross-sectional representation of a first embodiment of the present invention.

FIG. 1 shows a first embodiment of a pump according to the present invention. The pump comprises a pump body 10 having a platelike structural design and a displacer 12 secured to said pump body via connections 18 whose structural design depends on the material used. A pump chamber 14 is defined by a recess in the pump body 10. In addition two openings, a first opening 15 and a second opening 16, are provided in said pump body, said openings being adapted to have connected thereto the fluid lines of the fluid to be pumped. In the first embodiment, an elastic buffer 13 is implemented as a diaphragm by reducing the thickness of the pump body 10, said diaphragm being deformable in a pressure-dependent manner.

The displacer 12 can periodically be moved to and from between two end positions by a drive means (not shown). At the first end position, the displacer 12 closes the first opening 15 constituting the inlet in the normal mode of operation of the pump. At the second end position, the displacer 12 leaves the first opening 15 free. The second opening 16 constituting the outlet in the normal mode of operation of the pump is open during a whole pumping cycle irrespectively of the position of the displacer 12.

Figure 2:
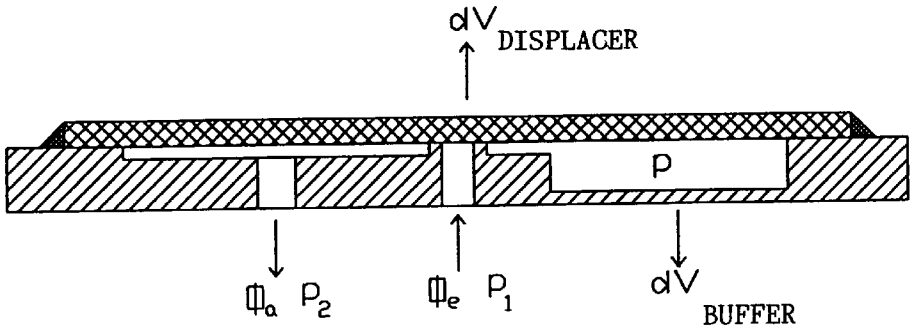
FIG. 2 shows a representation of the essential pumping parameters of the pump shown in FIG. 1.

In the following, the pumping mechanism of the pump shown in FIG. 1 will be explained in detail. For this explanation, the first opening 15 is regarded as inlet opening and the second opening 16 is regarded as outlet opening. In FIG. 2, the essential parameters, which are required for explaining the pumping mechanism, are shown.

Let us assume that the hydrostatic pressure p1 prevails on the inlet side, the hydrostatic pressure p2 on the outlet side and the pressure p in the pump chamber. The flow rate through the two openings is referred to as $\phi_e$ for the inlet opening 15 and $\phi_a$ for the outlet opening 16. The displacer, whose position of rest corresponds to the first end position at which the inlet opening is closed in accordance with the first embodiment, is moved to its second end position by actuating the drive means, whereby the volume of the pump chamber is changed by a defined volume amount dV*. A pressure-dependent volume displacement of the elastic buffer is referred to as $V_{buffer}$. It is positively weighted when the diaphragm 13 bulges out of the pump chamber 14 and negatively weighted when said diaphragm is deformed into the interior of said pump chamber 14.

The volume of the pump chamber is consists of a basic volume $V_0$ of the pump chamber 14, the deflection of the displacer 12 $V_{displacer}$ and the volume deformation of the buffer volume $V_{buffer}$ according to the following equation:

$$V_{pump\ chamber}=V_0+V_{buffer}(p)+V_{displacer} \quad (1)$$

A change in the pump chamber volume $dV_{pump\ chamber}$ is consequently of the following form:

$$dV_{pump\ chamber}=dV_0(p)+dV_{buffer}(p)+dV_{displacer} \quad (2)$$

The continuity equation for the volume of the pump chamber is as follows:

$$dV_{pump\ chamber}/dt=\phi_e(p_1-p)-\phi_a(p-p_2) \quad (3)$$

An entire pumping cycle can be subdivided into four substeps; making some simplifying assumptions, the temporal developments can be calculated on the basis of equation (2) and equation (3). In the following, the temporal behavior of the individual pump components in the four substeps as well as the pumping effect resulting therefrom will be explained. In so doing, a pump chamber is first taken as a basis, which is completely filled with an incompressible medium, e.g. a liquid with $dV_0/dp\approx 0$. The following holds true:

$$dV_0(p)=[dV_0(p)/dp]dp=0 \quad (4)$$

Substep 1

Starting from the first end position, i.e. the end position at which the displacer 12 closes the inlet opening 15, said displacer 12 is moved upwards by a defined volume dV* within a very short period of time, $dt\approx 0$. This results in a corresponding volume deformation of the elastic buffer volume, i.e. of the diaphragm 13, into the pump chamber, since the pump chamber content has been assumed to be incompressible and since the volume change of the displacer 12 cannot be compensated for by the fluid flows $\phi_e$ and $\phi_a$ within the short period of time $dt\approx 0$. Assuming that $dt\approx 0$, it follows from equation (3) that $dV_{pump\ chamber}\approx 0$ and, consequently, from equations (2) and (4) that $dV_{buffer}=-dV_{displacer}=-dV^*$. The deformed buffer volume produces in the pump chamber 14 a negative pressure that can be calculated via the characteristic $V_{buffer}(p)$.

Substep 2 (Suction Phase)

Due to the negative pressure generated in the pump chamber, fluid flows now take place through the inlet and the outlet opening. According to the amount of fluid that has flown into the pump chamber, the buffer volume relaxes, whereby the negative pressure produced by said buffer volume decreases. The temporal development of the pump chamber pressure in this pumping phase results from equations (2) and (3) as follows:

$$dp/dt=[\phi_e(p_1-p)-\phi_a(p-p_2)]/[dV_{buffer}/dp] \quad (5)$$

If the flow resistances of the inlet opening and of the outlet opening are identical and if the hydrostatic pressures $p_1$ and $p_2$ correspond to the ambient pressure, identical amounts of fluid will flow through the inlet opening and through the outlet opening into the pump chamber 14.

Substep 3

Starting from the second end position, i.e. from the end position at which the inlet opening was free, the displacer is now moved downwards by a defined volume $dV_{displacer}=-dV^*$ within a very short period of time, $dt\approx 0$. The inlet opening is now closed. The downward movement of the displacer 12 results in a corresponding volume deformation of the elastic buffer, i.e. of the diaphragm 13 in the first embodiment, out of the pump chamber 14, since the pump chamber content has been assumed to be incompressible and since the volume change of the displacer 12 cannot be compensated for by the fluid flows $\phi_e$ and $\phi_a$ through the openings 15, 16 within said short period of time. When the temporal development takes place within $dt \approx 0$, it follows from equation (3) that $dV_{pump\ chamber} \approx 0$ and, consequently, from equations (2) and (4) that $dV_{buffer} = -dV_{displacer} = +dV^*$. The deformed buffer volume now produces in the pump chamber an excess pressure that can also be calculated on the basis of the pressure characteristic $V_{buffer}(p)$ of the buffer.

Substep 4 (Pumpina Phase)

After substep 3 the inlet opening 15 is closed by the displacer 12. It follows that the fluid flow occurring due to the excess pressure in the pump chamber 14 can leave the pump chamber only through the oulet opening 16. According to the amount of fluid that has flown out of the pump chamber, the buffer volume relaxes, whereby the excess pressure produced by said buffer volume is reduced. The temporal development of the pump chamber pressure in this phase results again from equations (2) and (3) as follows:

$$dp/dt = [-\phi_a(p-p_2)]/[dV_{buffer}/dp] \quad (6)$$

As can be seen from the above explanations, the fluid amount $dV^*$ is sucked in through the inlet an outlet openings 15, 16 during substep 2, whereas it is displaced through the outlet opening 16 alone during substep 4. When the flow resistances of the inlet and outlet openings are identical and when the pump operates without load, i.e. $p_2 = p_1 = 0$, 50% of the displacement volume $dV^*$ are transported from the inlet 15 into the outlet 16 according to the net balance over one entire cycle.

From a comparison of equations (5) and (6), it can be seen that substep 2, the suction phase, takes place faster than substep 4, the pumping phase. The cause for this is that the negative pressure in the suction phase is compensated by a fluid flow through both openings, whereas the excess pressure in the pumping phase must be compensated by only one opening, the outlet opening 16.

By varying the flow resistances of the inlet and outlet openings, i.e. by changing the cross-sections of the two openings, the pump efficiency can be varied. Especially by increasing the flow resistance on the outlet side relative to the inlet side, the efficiency can be optimized to well above 50% in the load-free case. The reason for this is that a markedly smaller amount of fluid flows back from the outlet into the pump chamber during the suction phase. The increase in the flow resistance on the outlet side results, however, in a corresponding extension of the pumping phase according to equation (6).

Suction and pumping phases of different durations can be taken into account in the displacer control by selecting a clock ratio other than 50%, i.e. by controlling the time sequence of driving the displacer into the first and into the second end position. In the case of an increased flow resistance on the outlet side, this means that the suction phase is reduced by the way in which the displacer is controlled, whereas the pumping phase is extended.

Figure 3:
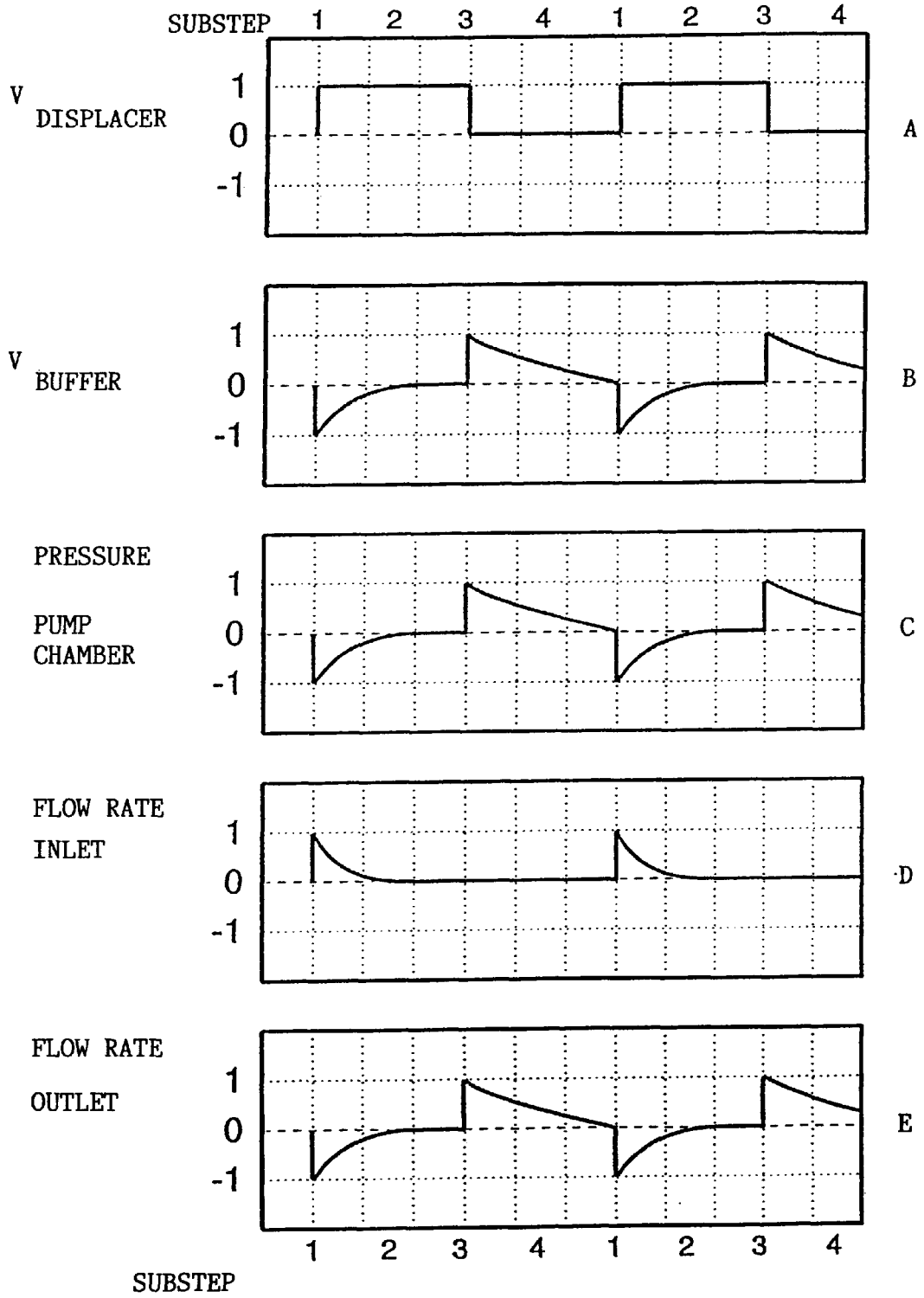
FIG. 3 shows a representation of the transient processes of the individual components of the pump shown in FIGS. 1 and 2.

In FIG. 3, transient processes in the pump according to FIG. 1 are shown in the form of a diagram.

Curve "A" shows the sequence of displacer movements during a pumping cycle in the four substeps 1, 2, 3 and 4. In step 1, the displacer is deflected upwards very rapidly to a position at which it remains during step 2. The inlet opening is open in this condition. In step 3, the displacer is moved downwards very rapidly, whereupon it closes the inlet opening and remains in this condition during step 4.

Curve "B" shows the reaction of the buffer which consists of diaphragm 13 according to the embodiment of FIG. 1. This elastic buffer element in the form of diaphragm 13 is able to deform in accordance with the pressure conditions. During step 1, the volume change of the displacer is compensated for by the deformation of the buffer. During step 2, the deformation of the buffer decreases due to the fluid flows through the inlet opening and the outlet opening, respectively. In step 3, the buffer element deforms downwards and compensates in this way the rapid volume change of the displacer. During substep 4, this deformation decreases again due to the fluid flow through the outlet opening.

Curve "C" is representative of the pump chamber pressure. Since the pump chamber pressure depends on the deformation of the buffer, its characteristic corresponds essentially to the characteristic of the volume change caused by the buffer.

Curve "D" shows clearly the flow rate through the inlet opening. A rectifier effect can be inferred from curve "D", since the inlet is closed in step 3 and remains closed during substep 4 during which an excess pressure prevails in the pump chamber. A flow of fluid from the pump chamber back into the inlet side is prevented in this way.

Curve "E" shows the flow rate through the outlet opening. Since the outlet opening is open at both end positions of the displacer, the fluid flows through said outlet opening in step 2 as well as in step 4. The net transport of fluid through the inlet and outlet openings is given by the integral over one of the two curves "D" or "E". In the normal mode of operation, the net transport is directed from the inlet to the outlet.

In FIGS. 4*a* to 4*e*, the pump according to the first embodiment, which is shown in FIG. 1, is shown during the various substeps of a pumping cycle.

Figure 5:
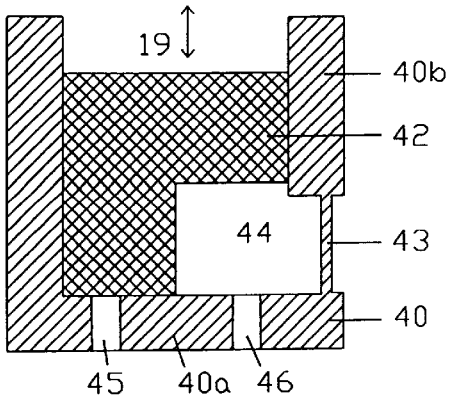
FIG. 5 shows a sectional view of a fluid pump.
Figure 6:
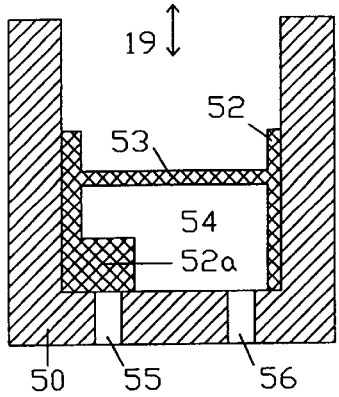
FIG. 6 shows a cross-sectional view of another fluid pump.
Figure 7:
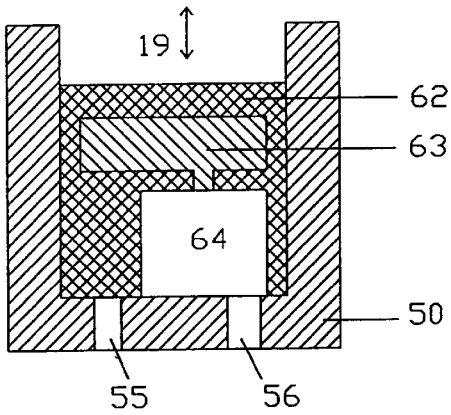
FIG. 7 shows a sectional view of yet another fluid pump.

FIGS. 5, 6 and 7 show fluid pumps.

FIG. 5 shows a pump in the case of which a buffer 43 is arranged in a pump body 40. The pump body 40 comprises a base plate 40*a* and side walls 40*b* defining together a hollow body delimited by said side walls 40*b* and said base plate 40*a* and open on one side thereof, which is the side facing upwards in FIG. 5. When the base plate has a round shape, the side walls are implemented such that a tubular structure is defined. An inlet opening 45 and an outlet opening 46 extend through the base plate. A displacer 42 is provided in the hollow space and delimits said hollow space at the open side thereof, said displacer 42 being adapted to be moved in said hollow space like a piston with the aid of a drive means (not shown) in the direction indicated by arrow 19.

A pump chamber 44 is defined by a recess of the displacer 42 and by the pump body 40. The elastic buffer 43 is formed in the pump body 40, i.e. in the side wall 40*b* of the basic body 40. For this purpose, the side wall 40*b* includes, in a region bordering on the pump chamber 44, an area of reduced thickness so that a diaphragm-like structure is obtained.

FIG. 6 shows a further fluid pump. A pump body 50 of this third embodiment has the same structural design as the pump body 40 of the pump shown in FIG. 5, with the exception that the elastic buffer is not formed in said pump body. The pump body 50 has again arranged therein a displacer 52 which is adapted to be moved like a piston in the direction of arrow 19. When seen in a cross-sectional view, the displacer 52 has the shape of an H, one leg of said H being provided with a projection 52*a* used for closing an inlet opening 55 in the pump body 50. An outlet opening 56 in the pump body 50 is always open. The displacer 52 is implemented such that it is adapted to close the pump body 50 towards the open side thereof. Depending on the shape of the pump body 50, said displacer can have an arbitrary round, polygonal, elliptical, etc., shape.

On the basis of the shape of the displacer 52, a pump chamber 54 is again defined between the displacer 52 and the pump body 50. In contrast to the pump that has been described with regard to FIG. 5, the elastic buffer is, however, not formed in the pump body 50, but in the displacer 52. The elastic buffer is in this case implemented as diaphragm 53 in the displacer 52.

FIG. 7 shows yet another fluid pump. In FIG. 7, components which correspond to those of FIG. 6 are designated by identical reference numerals. The pump body is identical with the pump body shown in FIG. 6. An elastic buffer element 63 is arranged in a displacer 62 in such a way that the elastic buffer element 63 has a boundary surface to a pump chamber 64 defined by the displacer 62 and the pump body 50. When this pump is in operation, the elastic buffer element 63 is compressed and expanded, whereby the mode of operation explained hereinbefore is again obtained.

In addition to the elastic buffers shown, the function of the elastic buffer element can also be fulfilled by an elastic medium in the pump chamber. Examples are gas that is enclosed in a liquid-filled chamber or also a rubber-like material in the pump chamber. In this case, the elastic diaphragm, which, being a part of the displacer or of the pump body, constitutes a portion of the pump chamber boundaries, can be dispensed with. If the medium to be pumped is compressible, e.g. gas, the buffer function can be fulfilled by said medium itself, additional mechanical components for realizing the buffer being not necessary in this case. The stroke of the displacer in the above-explained steps 1 and 3 will then first be compensated for by expansion and compression, respectively, of the elastic medium in the pump chamber or of the medium to be pumped itself. In steps 2 and 4, respectively, the volume deformation of the medium will relax due to fluid flows through the openings, as has been described hereinbefore with reference to the first embodiment. It follows that, for realizing a gas pump by means of which only gas is pumped, it will suffice to provide a displacer and two openings, the displacer closing periodically one of the two openings.

In the above description of the pumping mechanism, a forcibly-controlled volume displacer has been taken as a basis in the case of which there is no feedback between the displacer position and the pump chamber pressure. For this kind of realization, drive mechanisms with a very high force density are required. The pumping mechanism functions also in cases where such feedback or coupling exists.

Figure 8:
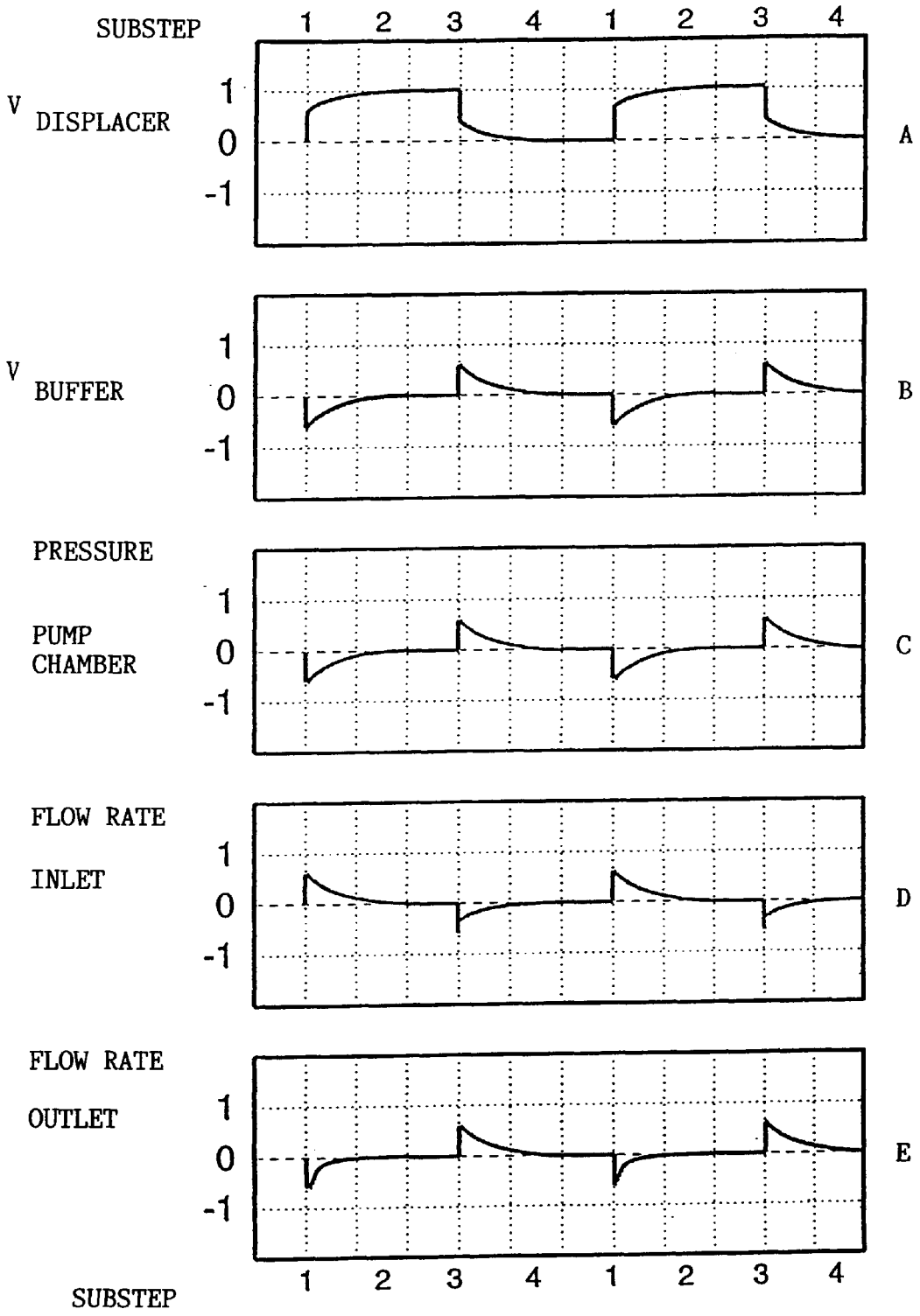
FIG. 8 shows a representation of the transient processes of the individual components in cases where feedback exists between the pump chamber and the displacer.

A representation of the transient processes of the individual components, e.g. of the components of the embodiment shown in FIG. 1, when there is a feedback between the pump chamber and the displacer, i.e. when the displacer is not forcibly controlled, is shown in FIG. 8. In this case, the displacer will not fully reach its final end position in step 1, but it will reach said end position only towards the end of substep 2. Accordingly, the displacer need not close the inlet opening completely at the end of substep 3, but it will suffice when said inlet opening is fully closed during substep 4 as the pressure becomes more and more balanced. For the pumping effect, a very fast control of the displacer within a very short period of time $dt \approx 0$ will additionally be advantageous, but not absolutely necessary.

According to one advantage of the present invention, it is possible to implement, without any additional expenditure, the position of the displacer in the switched-off mode of the pump in such a way that fluid flow in both directions is impossible due to the fact that the displacer blocks the inlet opening. If the displacer is forcibly controlled and if its position is not influenced by the pressure prevailing in the pump chamber, this will have the effect that the fluid line is blocked in both directions without any additional expenditure. If a feedback exists between the displacer position and the pump chamber pressure, the drive of the displacer can be implemented such that it will press the displacer actively onto the inlet opening whereby a flow of fluid will actively be prevented. If the displacer is a piezoelectrically driven displacer, which is actuated e.g. by means of a piezostack actuator, a piezodisk or a piezo-bending converter, this will only require a polarity reversal of the operating voltage.

According to a further advantage, the pumping direction of a fluid pump according to the present invention can be reversed. When the displacer is controlled with a frequency lying above the mechanical resonance of the buffer in the surroundings in question, i.e. in the fluid to be pumped, a phase displacement of more than 90° is obtained between the expansion or compression of the buffer element and the opening condition of the inlet opening, said opening condition being defined by the position of the displacer. It follows that the buffer in the pump chamber receives pump medium in the closed condition of the inlet opening and discharges pump medium in the open condition of the inlet and outlet openings. This results in a pumping direction opposite to the pumping direction described hereinbefore. In this case, the pumping direction from the outlet opening to the inlet opening is reversed.

The advantage in comparison with the already existing, bi-directional micropump is to be seen in the fact that (i) passive valves can be dispensed with completely, and that (ii), other than in the case of the resonance of a passive check valve, the resonant frequency of the buffer can be adjusted independently of other important magnitudes, such as the flow resistance of the valve, the fluidic capacity, the size of the valve and its mechanical stability.

It follows that resonant frequencies can be reduced to a range of <200 hertz, whereby the expenditure for the electrical and mechanical control of the displacer will be reduced substantially. In contrast to this, the resonance in the case of passive valves lies in the range of 2000 hertz to 6000 hertz. Due to the reduction of the resonant frequency, the inertia forces acting on the displacer are much smaller. In addition, the mechanism can be realized not only in the case of microscopic pumps delivering small moved masses, but it can also be realized in a macroscopic structural design.

A further advantage of a fluid pump according to the present invention is obtained when said fluid pump is implemeted as a micropump. Although micropumps having a conventional structural design are capable of transporting liquids as well as gases, none of these micropumps is self-priming, i.e. they are not able to independently replace the gas in a gas-filled pump chamber by liquid in the course of the pumping process. This makes it much more difficult to use said pumps in practice. In the following, the causes of the non-existing self-priming effect will be discussed in detail.

In micropumps provided with passive check valves, capillary forces are an important factor. As soon as the liquid level has reached the inlet valve and wets the movable valve member, the valve flap or the valve diaphragm, capillary forces will occur which strongly limit the movement and which substantially increase the force required for moving the elastic valve member. These forces will not be neutralized and the pump will not be in its normal pumping mode until the whole movable valve member is completely surrounded by liquid.

Since the passive check valves of conventional micropumps are not controlled from outside, the driving force cannot be used directly for overcoming the capillary forces, but it is first necessary to compress or expand the gas in the pump chamber by means of the drive, and it is only via the gas pressure that a force for overcoming the capillary forces is transmitted to the valves. This indirect force transmission via a compressible gas in combination with the fact that the net surface on the movable valve member which is acted upon by the pressure is very small entails extreme losses when the force of the drive is transmitted to the check valve and prevents the self-priming effect in the presently known micropumps.

When micropumps are realized with nozzles instead of check valves, for defining the pumping direction, a pumping effect will only occur if the flow resistance of each individual nozzle in the pumping direction is smaller than that in the direction opposite to said pumping direction. When averaged over the whole pumping cycle, this means for the inlet nozzle that the volume flow rate into the pump chamber must be higher than the volume flow rate out of the pump chamber. However, as soon as the meniscus of the liquid reaches the inlet nozzle, the flow resistance of the nozzle will change dramatically due to the higher density of the liquid. Assuming a typical density variation value of 1,000, the flow resistance will change by a factor $(1000)^{1/2} \approx 30$. Since liquid must flow through the nozzle in the pumping direction, the volume flow rate is much smaller than that in the direction opposite to the pumping direction because it is in this case gas that flows through the nozzle. In this situaton, the pumping effect collapses, and a self-priming effect is not given for this reason.

In contrast to the above-described known micropumps, the pump according to the present invention permits the actuator to be used directly for overcoming the capillary forces. Due to the direct force transmission from the drive to the component wetted by a liquid, forces that are much higher are available for overcoming the capillary forces. Hence, the displacer can work in spite of wetting.

Figure 9:
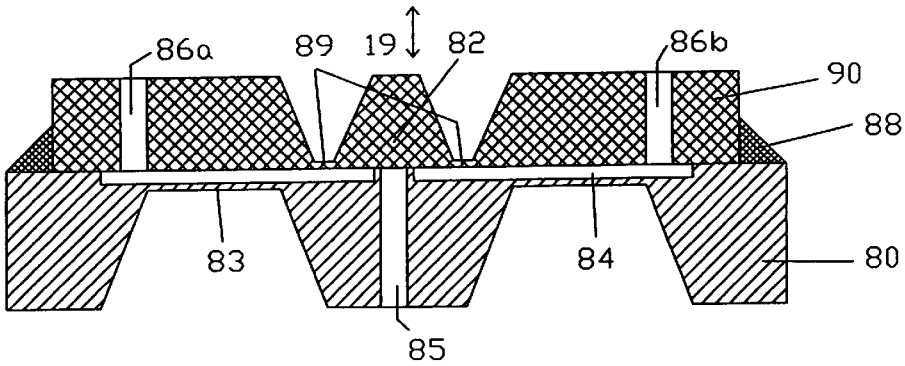
FIG. 9 shows a second embodiment of a pump according to the present invention.

FIG. 9 shows a second embodiment of a pump according to the present invention.

In this embodiment, the displacer 82 is part of a second pump body 90. The second pump body 90 is structured, i.e. it is provided with portions of increased thickness and with portions of reduced thickness 89 so as to provide an elastic suspension for the displacer 82. The second pump body 90 is secured to a pump body 80 via connections 88. The pump chamber 84 is formed as a capillary gap between the pump body 80, the displacer 82 and the second pump body 90. The pump body 80 is provided with an inlet opening 85 which is closed by the displacer 82 when said displacer occupies the first end position. The displacer 82 can again be moved in the direction of arrow 19. The second pump body 90 is provided with two outlet openings 86*a* and 86*b*. The buffer of this embodiment is again implemented as a diaphragm located in said pump body 80.

In accordance with an alternative embodiment, the buffer could be realized by the portions of reduced thickness 89 which serve as elastic suspensions for the displacer 82; the buffer in the in the pump body 80 could then be dispensed with. In this case, it would be advantageous if the portions of reduced thickness 89 were larger than those shown in FIG. 9.

When the construction height of the pump chamber 84 is implemented as a capillary gap, as has been done in the present embodiment, said pump chamber will fill automatically as soon as a meniscus of liquid abuts on this gap. Such a reduction of the height of the pump chamber is impossible in conventional micropumps provided with check valves, since this would restrict the motion of the valves. In micropumps with flow nozzles, the pump chamber will constitute an additional flow resistance when the pump chamber height is reduced drastically. This inner flow resistance of the pump chamber dominates over the flow resistance of the nozzles so that the pumping effect based on the preferred direction of the nozzles will break down.

In the embodimemts which have been described up to now, the second opening, which corresponds to the outlet opening during normal operation of the pump, is always open.

In FIGS. 10*a* to 10*e*, a third embodiment of a pump according to the present invention is shown during the various substeps of a pumping cycle.

Figure 10:
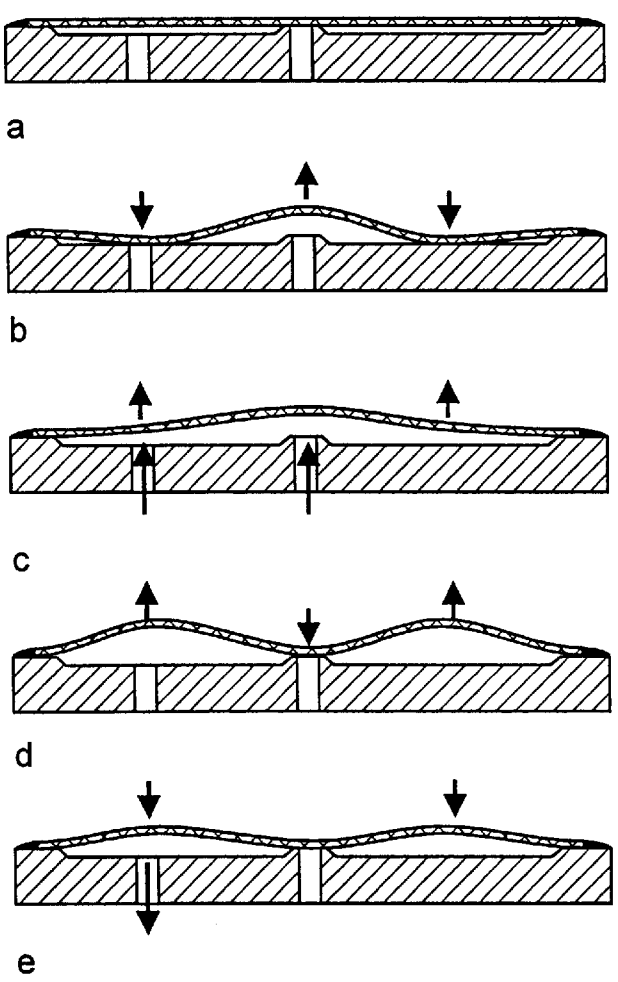
FIGS. 10*a* to 10*e* show graphic representations of a pump according to a third embodiment of the present invention during a pumping cycle.
Figure 4:
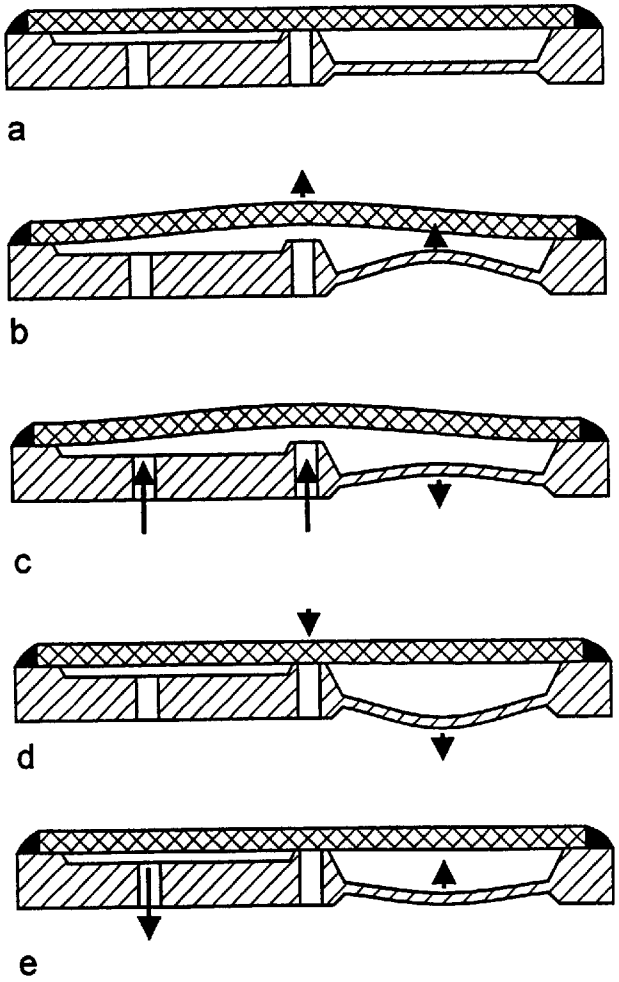
FIGS. 4*a* to 4*e* show graphic representations of the pump of FIG. 1 during a pumping cycle.

In a pump according to FIGS. 10*a* to 10*b*, the buffer is formed in the displacer in such a way that the displacer and the buffer are implemented as different areas of a diaphragm which spans the pump body so as to define the pump chamber. The structural design of the pump body is similar to that of the first embodiment with the exception that it has not formed therein the buffer. Such a structural design of the pump according to the present invention permits the manufacturing process to be simplified still further.

It follows that the present invention provides a pump which is based on a new type of mechanism, which does not require any check valves at all, and which permits the pumping direction to be reversed without causing a change of the operating direction of valves from outside. Hence, the pump according to the present invention has a much simpler structural design. Furthermore, the displacer can simultaneously be used for the purpose of blocking a fluid flow over the pump in both directions passively or actively when the pump has been switched off.

The present invention also provides a pump which offers advantages when the pumping direction is being reversed. According to the present invention, the resonance of the mechanical component, which is the valve in the conventional case and the buffer element in the case of the present invention, can be adjusted independently of the flow resistance, the size, the fluidic capacity, and the mechanical stability of a valve. This provides the possibility of miniaturizing the components still further on the one hand and of achieving an average reduction of the resonant frequencies on the other. In the case of conventional micropumps, these two effects are oppositely oriented.

In contrast to conventional micropumps, in which typical resonant frequencies range from 2000 to 3000 hertz, a reversal of the pumping direction of a pump according to the present invention can already be effected at frequencies of 40 hertz. The expenditure for the electrical and mechanical control of the displacer will be reduced substantially in this way. In addition, the inertia forces acting on the displacer are much smaller and the mechanism can be realized not only in microscopic pumps but also in a macroscopic structural design.

In comparison with pumps having flow nozzles, the pump according to the present invention, which is capable of functioning without any check valves, has an efficiency which is increased by more than 50% per pumping cycle.

When the pump according to the present invention is implemented as a micromechanical pump, it can consist of a single sructured component in which the displacer is realized and of a base plate with two openings. These simple structures permit the entire system to be assembled without any problems. A basic structure consisting of Pyrex permits anodic bonding of the structured silicon component to the basic body of Pyrex which serves as a pump body. The openings in the basic structure can be implemented as simple holes or in an arbitrary shape. This will substantially reduce the expenditure in comparison with the production of flow nozzles. In addition, the basic structural design of the micropump can be round or it may have any other arbitrary shape.

The materials which can be used for the micropump are, in addition to silicon, almost all other materials, such as metals, plastic materials, glass, ceramic materials. A simple production by injection moulding of plastic materials is possible, and other possibilities are a production by means of die casting metal or by means of the LIGA method.

The drive of the micropump, i.e. of the displacer, can be effected by all known actuator methods, e.g. piezoelectrically, pneumatically, thermopneumatically, thermomechanically, electrostatically, magnetically, magnetostrictively or hydraulically.

A control circuit can be established via integrated sensors, which are integrated e.g. in the buffer diaphragm, the drive of the micropump being brought to the respective optimum operating range by said control circuit.

The field of use of the pump according to the present invention covers the whole sphere of microfluidics and fluidics, since the medium can be transported bidirectionally as well as blocked in a defined manner. The extremely small size permits the construction of extremely small mixing and dosage systems in the fields of medical, chemical and analytical technology. According to B. H. van de Schoot, S. Jeanneret, A. van den Berg and N. F. de Rooji; A silicon integrated miniature chemical analysis system; Sensors and Actuators, B, 6 (1992), pages 57–60, two pumps are used for this kind of application, whereas, if the pump according to the present invention were used, only one pump would suffice. The pump principle is generally suitable for use in a wide field of constructional sizes so that the injection moulding technique can be used as an economy-priced production technique in many cases.

Figure 11:
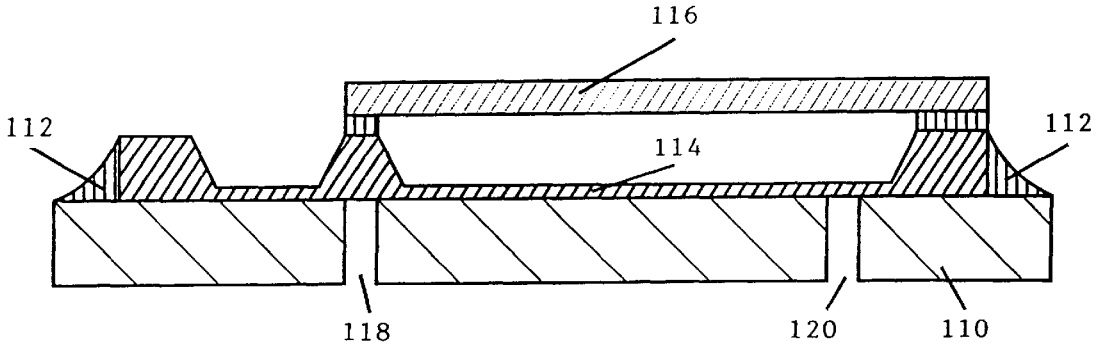
FIG. 11 shows a cross-sectional representation of a fourth embodiment of a fluid pump according to the present invention.
Figure 14:
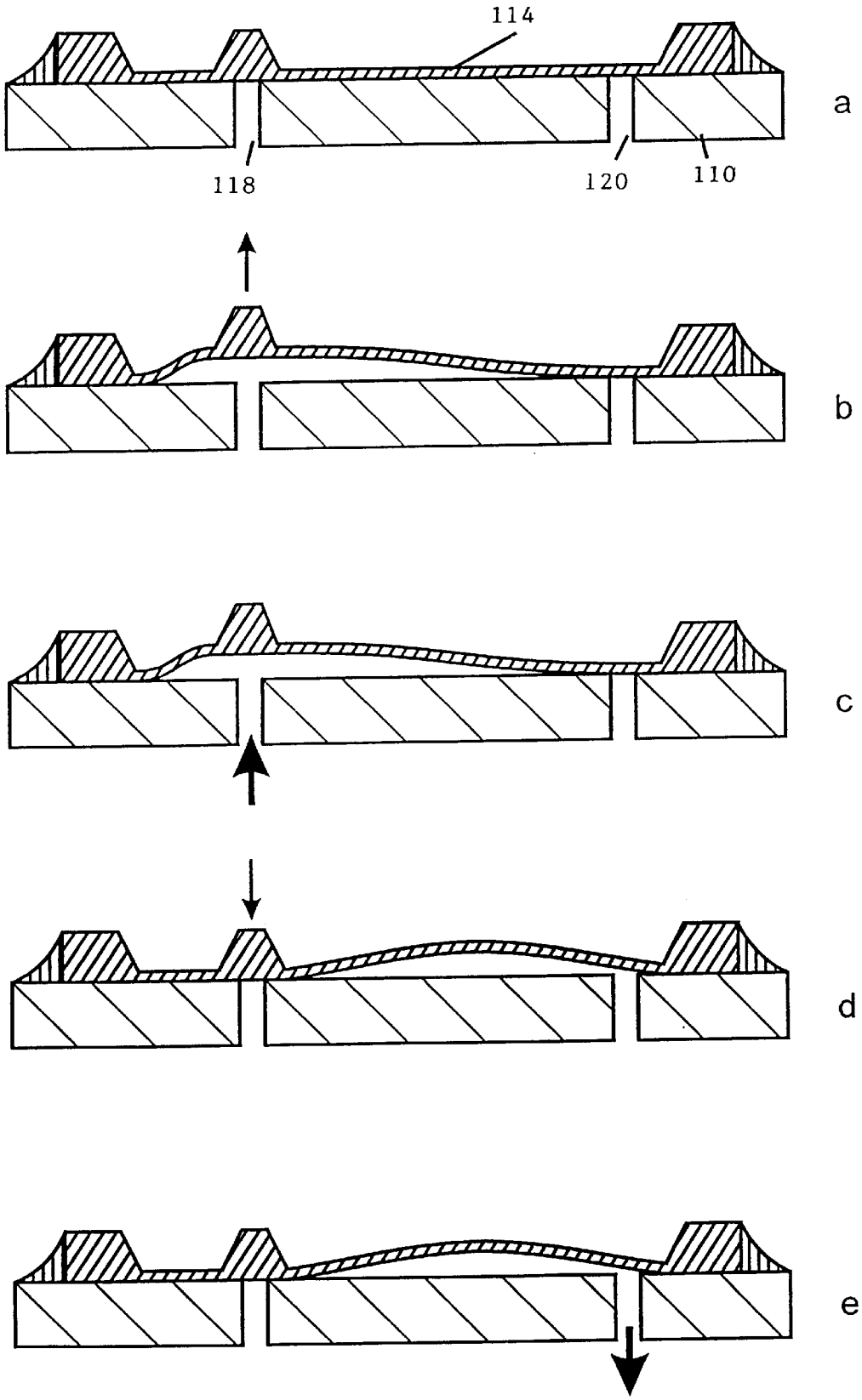
FIGS. 14*a* to 14*e* show graphic representations of the pump of FIG. 11 during a pumping cycle.

FIG. 11 shows a fourth embodiment of a self-priming fluid pump according to the present invention. The fluid pump comprises a pump body 110 having attached thereto a displacer 114 in the form of a diaphragm 114 with the aid of a connection means 112. The diaphragm 114 can have areas of increased thickness along the sections at which the displacer is secured to the pump body 110. The diaphragm 114 is adapted to be moved from the position which is shown in FIG. 11 and which will be referred to as first end position hereinbelow to a second end position with the aid of a drive means 116 which can be a piezoelectric, a pneumatic, a thermopneumatic, a thermomechanical, an electrostatic, a magnetic, a magnetostrictive or a hydraulic driving arrangement. According to this embodiment, the pump body 110 is provided with two openings 118 and 120 which may be connected e.g. to inlet and outlet fluid lines (not shown). In the pump shown in FIG. 11, opening 118 constitutes the inlet opening, whereas opening 120 constitutes the outlet opening. The diaphragm 114 is connected to the drive means 116 preferably directly above the inlet opening 118 so as to permit the operation of the pump, which will be explained hereinbelow making reference to FIG. 14. For fastening the drive means, the diaphragm 114 can have an area of increased thickness at the point at which it is connected to the drive means 116.

The self-priming, self-filling micropump shown in FIG. 11 differs from known micropumps insofar as, when in operation, it opens alternately the first opening 118 while the second opening 120 remains closed, whereupon it opens the second opening 120 while the first opening is closed. In the case of the pump shown in FIG. 11 only one opening, 118 or 120, is open at any one time, whereas the other opening is closed. In the inoperative phase, both openings 118 and 120 are closed, whereby defined blocking of the pump medium is obtained.

Figure 12:
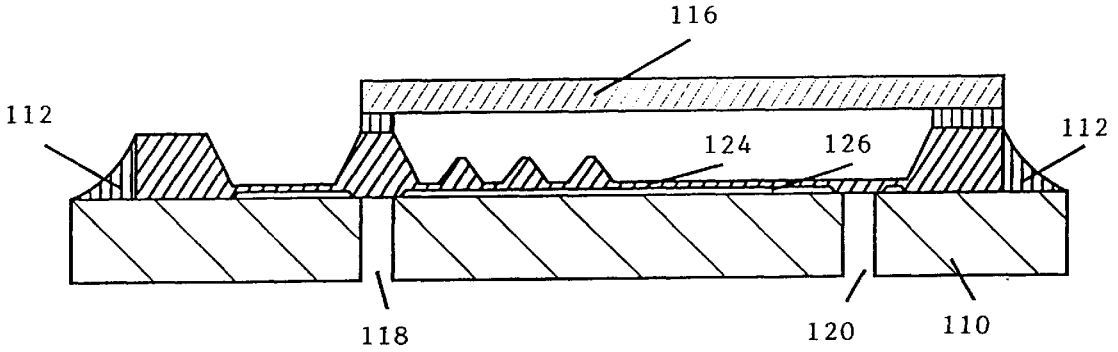
FIG. 12 shows a cross-sectional representation of an fifth embodiment of a fluid pump according to the present invention.

In FIG. 12, a fifth embodiment of a fluid pump according to the present invention is shown. The fluid pump comprises again a pump body 110 having a diaphragm 124 attached thereto with the aid of a connecting means 112. In this embodiment, a capillary gap 126 is, however, formed between the diaphragm and the pump body. For closing the openings 118 and 120 when the displacer, i.e. the diaphragm 124, is at the position of rest, the diaphragm is provided with areas of increased thickness at the locations of the openings, said areas of increased thickness facing the surface of the plate of the pump body 110. The diaphragm has again attached thereto a drive means 116.

On the upper side of the diaphragm 124, i.e. on the side facing away from the pump body, structured portions can be formed, which permit an optimum adaptation and evacuation of the buffer volume. In addition, structured portions, which may e.g. be implemented as flow passages, on the upper surface of the pump body, i.e. the upper surface facing the diaphragm 124, or on the lower surface of the diaphragm can be used for filling and emptying the pum in the best possible way.

Alternatively to the embodiment shown in FIG. 12, the openings 118 and 120, which are provided in the pump body 110, could also be provided with raised portions surrounding the same. In this case, it would not be necessary to provide the diaphragm 124 with areas of increased thickness facing the pump body 110 so as to permit the openings 118 and 120 to be closed.

Figure 13:
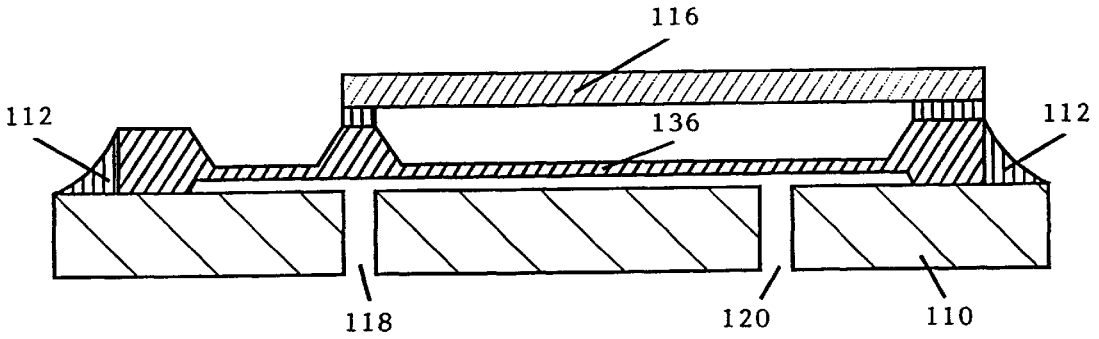
FIG. 13 shows a cross-sectional representation of a sixth embodiment of a fluid pump according to the present invention.

In FIG. 13, a sixth embodiment of a fluid pump according to the present invention is shown. In the pump shown in FIG. 13, a capillary gap is formed between the pump body 110 and a diaphragm 136 defining a displacer. According to this embodiment of the present invention, it is important that the two openings 118 and 120 are arranged in spaced relationship with one another on different sides of a central axis of the diaphragm 136. Due to this asymmetrical structural design of the pump according to the present invention, a self-priming and self-filling operation of the micropump according to the present invention is possible.

Making reference to FIGS. 14*a* to 14*e*, a pumping cycle of the pump shown in FIG. 11 will be explained hereinbelow. In this connection, it should be mentioned that the embodiment of the present invention shown in FIG. 12 performs the same type of pumping cycle when in operation.

In FIG. 14*a*, the pump is shown at its position of rest, which is also shown in FIG. 11. At this position, both connections are closed whereby absolute blocking of the medium is effected.

As can be seen in FIG. 14*b*, the displacer. i.e. the diaphragm 114, is then moved locally upwards from its position of rest in the direction of the arrow shown in FIG. 14*b*, whereby the inlet opening, the opening 118, is opened, whereas the outlet opening, the opening 120, remains closed. The position shown in FIG. 14*b* can be considered to be the second end position of the displacer.

In FIG. 14*c* it is shown how, due to the upward movement of the displacer, a medium to be pumped is drawn through the inlet opening, i.e. the opening 118, into the pump chamber defined by said upward movement of the displacer.

Following this, the displacer is abruptly and locally moved downwards, as can be seen in FIG. 14*d,* whereby the inlet opening is closed. Due to the deformation of the displacer, i.e. the deformation of the diaphragm 114, a buffer volume corresponding to the fluid volume taken in is defined between the diaphragm and the pump body, and this has the effect that the outlet opening is freed.

As can be seen in FIG. 14*e,* the buffer volume is emptied through the outlet opening, i.e. opening 120, whereby the medium to be pumped is "displaced" or rather transported through a "rolling displacement".

The pumping mechanism described hereinbefore with reference to FIGS. 14*a* to 14*e* results in a pumping direction from the inlet opening 118 to the outlet opening 120. By increasing the drive frequency to a frequency above the resonant frequency of the total system, which consists of the displacer and the fluid system, the pumping direction can be reversed. It is apparent that the inlet and outlet openings will then be changed round as well, i.e. that the inlet opening 118 will become the outlet opening, and the outlet opening 120 the inlet opening.

The volume of the medium taken in during each pumping cycle by the fluid pump according to the present invention through one opening corresponds to the volume of the medium discharged through the second opening. In contrast to known micropumps, the return flow and the dead volume occuring in the case of the pump according to the present invention, i.e. the volume which is only moved to and fro without contributing to the pumping process, approach zero in this arrangement. This has the effect that, in the micropump according to the present invention, autofilling in combination with diaphragm deformation and sequential opening of the openings become reproducible in connection with a simple control of the drive means.

FIGS. 15*a* to 15*e* show a pumping cycle of the sixth embodiment of a pump according to the present invention, said sixth embodiment being shown in FIG. 13. FIG. 15*a* shows that, starting from a position of rest, the diaphragm 136 is first moved downwards with the aid of the drive means 116 in such a way that the opening 118 is closed. In order to make the explanation more simple, opening 118 is again referred to as inlet opening, whereas opening 120 is referred to as outlet opening. The position of the diaphragm 136 shown in FIG. 15*a,* can be referred to as first end position.

As can be seen in FIG. 15*b,* the diaphragm 136 is then abruptly moved upwards. In this case, it is not always only one opening that is closed, whereas the other one is open. As can be seen in FIGS. 15*b* and 15*c,* also both openings are here open for a short period of time, but different amounts of the medium flow through said openings, since the opening heights, i.e. the distance at which the diaphragm extends above the openings, are different, which means that the flow resistance is different as well. It follows that the fluid stream flowing through the inlet opening 118 is larger than that flowing through the outlet opening 120. This is indicated in FIG. 15*c* by arrows of different thicknesses.

As can be seen in FIG. 15*d,* the diaphragm 136 is then abruptly moved downwards, whereby the opening 118 is closed. A pump volume is again defined between the diaphragm and the pump body; as can be seen in FIG. 15*e,* said pump volume is then emptied through the opening 120 due to the reversal of the deformation of the displacer.

Figure 15:
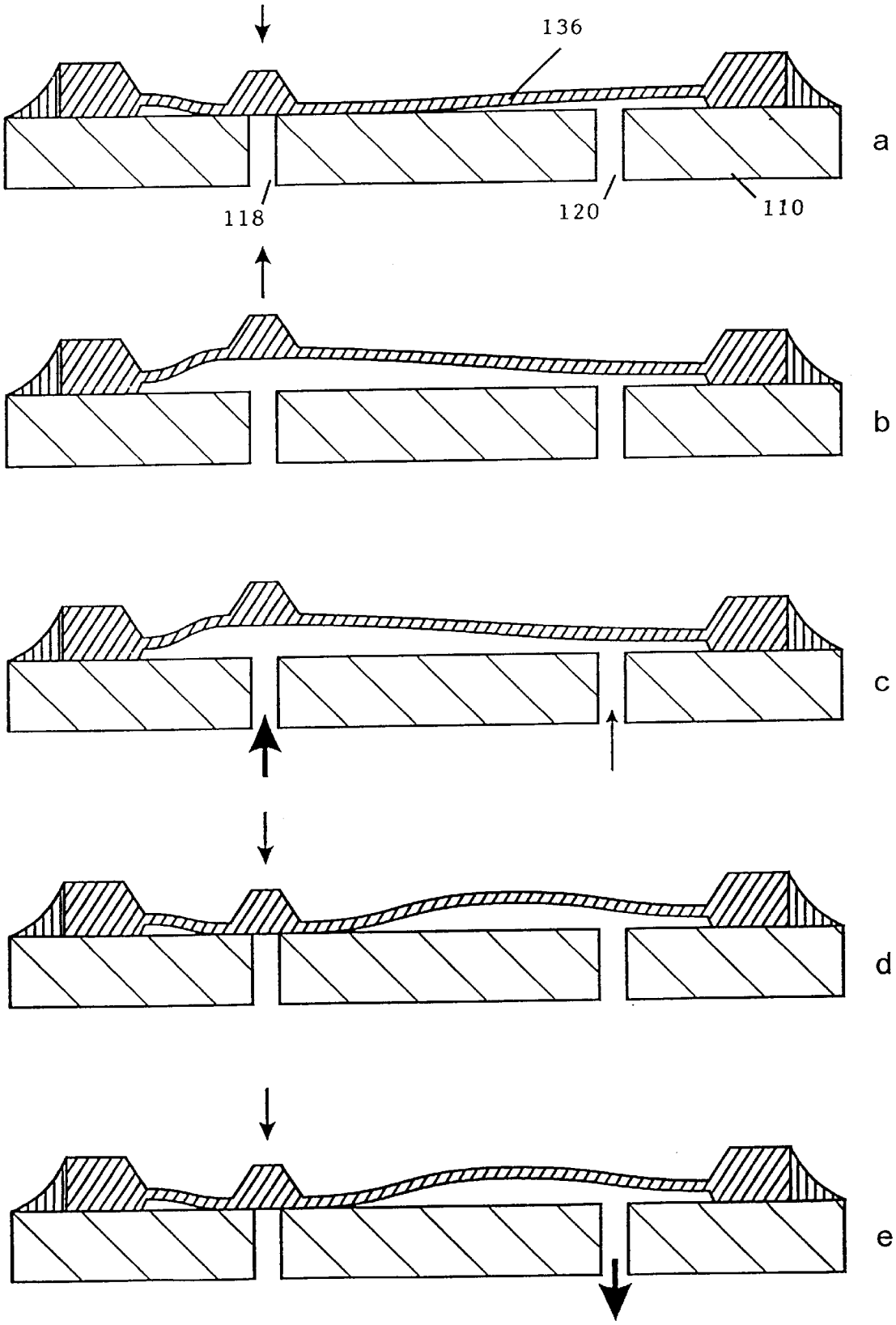
FIGS. 15*a* to 15*e* show graphic representations of the pump of FIG. 13 during a pumping cycle.

In the case of the fluid pump shown in FIG. 13, the operation of which has been explained with regard to FIG. 15, a dead volume exists which is larger than that existing in the case of the fourth and fifth embodiment of the present invention, which are shown in FIGS. 11 and 12. The sixth embodiment of the present invention described with regard to FIGS. 13 and 15 has therefore a lower efficiency than the embodiments described with regard to FIGS. 11 and 12.

The micropump according to FIGS. 11 and 12 can be filled automatically with a constant drive frequency. When the medium to be pumped has filled the pumping space or pump chamber and exits at the outlet opening, the drive frequency of the drive means driving the displacer can be reduced by a factor of 10 when a liquid medium is being pumped, since it is now no longer necessary to displace air, but only the liquid medium.

A basis for the pumping mechanism lies in the displacer deformation and the arrangement of the openings. The medium to be pumped is taken in through opening 118 and "displaced" towards opening 120 or it is transported through a "rolling displacement".

The pump body and the displacer means according to the present invention can preferably consist of silicon. In addition, they can also be manufactured by an injection moulding technique. All the drives known in the field of technology can be used as drive means. The transient curve shapes for the displacement, the pump chamber pressure, the displacer volume variation and the flow rate, which are characterisitc of the micropump, can easily be derived.

Alternatively to the fluid pumps shown, a capillary gap between the displacer diaphragm and the pump body plate could also be formed by a recess in the pump body plate.

It follows that the present invention permits, according to the second and third aspect thereof, the production of check valve-free, self-priming, i.e. self-filling micropumps for the first time. The field of use of the pumps according to the present invention covers the whole sphere of microfluidics and fluidics, since the medium to be pumped can be transported bidirectionally as well as blocked in a defined manner. Furthermore, the pumps according to the present invention can be produced with extremely little expenditure and with extremely small constructional sizes. On the basis of these small constructional sizes, the present invention permits the construction of extremely small mixing and dosage systems in the fields of medical, chemical and analytical technology; the pumps used in this connection have a good efficiency.

What is claimed is:

1. A fluid micropump, comprising:

a micropump body;

a displacer which is adapted to be positioned at a first and at a second end position by means of a drive, said displacer and said pump body being implemented such that a pump chamber is defined therebetween, and said pump chamber being adapted to be fluid-connected to an inlet via a first opening and to an outlet via a second opening, which openings are not provided with check valves; and an elastic buffer bordering on said pump chamber;

said displacer closing said first opening when it occupies said first end position and leaving said first opening free when it occupies said second end position; and said buffer being sufficiently elastic so as to be deformed by an abrupt movement of said displacer to form a buffer volume, and sufficiently resilient to provide pumping action subsequent to its deformation.

2. A fluid micropump according to claim 1 wherein said drive acts on said displacer substantially in the area of said first opening.

3. A fluid micropump according to claim 2 wherein said displacer has a first side substantially facing toward said first opening and a second side substantially facing opposite to said first opening, and said drive acts on said second side.

4. A fluid micropump according to claim 1 wherein said displacer comprises a plate which is secured to said pump body, and said pump body includes a recess defining said pump chamber.

5. A fluid micropump according to claim 1 wherein said buffer is arranged in said pump body.

6. A fluid micropump according to claim 5 wherein said buffer is implemented as a diaphragm comprising an area of reduced thickness in a wall of said pump body.

7. A fluid micropump according to claim 1 wherein said buffer is arranged in said displacer.

8. A fluid micropump according to claim 7 wherein said buffer is implemented as a diaphragm comprising an area of reduced thickness in the displacer.

9. A fluid micropump according to claim 1 wherein said buffer is formed by an elastic medium in said pump chamber.

10. A fluid micropump according to claim 1 wherein said buffer is formed by the medium to be transmitted itself.

11. A fluid micropump according to claim 1 wherein said displacer is integrated in a second pump body which is provided with portions of reduced thickness so as to provide an elastic suspension for said displacer.

12. A fluid micropump according to claim 1 wherein said displacer closes the first opening passively or actively in both flow directions when said micropump has been switched off.

13. A fluid micropump according to claim 12 wherein active closing of the first opening is effected by said drive which presses said displacer onto said first opening.

14. A fluid micropump according to claim 1 wherein the pumping direction of said micropump is reversible by operating said displacer at a frequency above the resonant frequency of said buffer.

15. A fluid micropump according to claim 1 wherein said pump chamber is implemented as a capillary gap.

16. A fluid micropump according to claim 1 wherein said displacer and said buffer are implemented as different areas of a diaphragm which spans said pump body so as to define said pump chamber.

17. A fluid micropump according to claim 1 wherein said displacer comprises a flexible member attached to said pump body in a fluid-tight manner along its circumference and said buffer comprises a portion of said displacer such that said buffer volume is formed between said portion of said displacer and said pump body by said abrupt movement of said displacer.

18. A micropump according to claim 16 wherein said displacer closes said first opening and said second opening when it occupies said first end position, and said drive acts on said flexible displacer essentially in the area of said first opening in such a way that said displacer opens said first opening, while said second opening is substantially closed, when said displacer is moved by said drive from said first end position to said second end position.

19. A fluid micropump according to claim 18 wherein said pump body is implemented in the form of a plate and said displacer is implemented in the form of a diaphragm in such a way that said diaphragm rests on a main surface of said plate when said displacer is at the first end position.

20. A fluid micropump according to claim 18 wherein said pump body is implemented in the form of a plate and said displacer is implemented in the form of a diaphragm in such a way that a capillary gap is formed between a main surface of said plate and said diaphragm.

21. A fluid micropump according to claim 20 wherein said first and second openings are arranged in said pump body, said diaphragm being provided with first and second areas of increased thickness directed towards said plate and closing said first and second openings when said displacer is at said first end position.

22. A fluid micropump according to claim 20 wherein said first and second openings are arranged in said pump body, raised portions being provided around said first and second openings in such a way that said diaphragm closes said first and second openings at said first end position.

23. A fluid micropump according to claim 18 wherein, when said micropump has been switched off, said displacer closes said first and second openings passively and/or actively.

24. A fluid micropump as in claim 17 wherein said first and second openings are arranged in spaced relationship with one another on different sides of a central axis of the displacer, and said displacer closes said first opening when it occupies said first end position and leaving said first opening free when it occupies said second end position.

25. A fluid micropump according to claim 24 wherein the pump body is implemented in the form of a plate and the displacer in the form of a diaphragm in such a way that a capillary gap is formed between a main surface of said plate and said diaphragm.

26. A fluid micropump according to claim 17 wherein the pump body and the displacer are made of silicon.

27. A fluid micropump according to claim 17 wherein the pump body and the displacer are produced by means of an injection molding technique.

28. A fluid micropump according to claim 17 wherein the pumping direction of the micropump is reversible by operating the displacer at frequency above the resonant frequency.

29. A method of micropumping a fluid, said method comprising the steps of:

providing: a micropump body and a displacer defining a micropump chamber, with said micropump chamber being fluid-connected to an inlet via a first opening and to an outlet via a second opening, which openings are not provided with check valves; and an elastic buffer bordering on said micropump chamber;

driving said displacer from a first end position in which said first opening is closed to a second end position in which said opening is free, with the movement of said displacer being sufficiently abrupt to deform said elastic buffer; and permitting said elastic buffer to relax to provide a pumping action.

30. A method of pumping a fluid, said method comprising the steps of:

providing: a pump body and a displacer defining a pump chamber, with said pump chamber being fluid-connected to an inlet via a first opening and to an outlet via a second opening, which openings are not provided with check valves; and an elastic buffer bordering on said pump chamber; said displacer having a first side substantially facing toward said first opening and a second side substantially facing opposite to said first opening, driving said displacer at a location on said second side and substantially in the area of said first opening from a first end position in which said first opening is closed to a second end position in which said opening is free, said movement being sufficiently abrupt to deform said elastic buffer; and permitting said elastic buffer to relax to provide a pumping action.

* * * * *